US012281818B2

(12) United States Patent
Choi

(10) Patent No.: US 12,281,818 B2
(45) Date of Patent: Apr. 22, 2025

(54) WAVY SMOKE TUBE STRUCTURE OF BOILER

(71) Applicant: Sung-Hwan Choi, Seoul (KR)

(72) Inventor: Sung-Hwan Choi, Seoul (KR)

( * ) Notice: Subject to any disclaimer, the term of this patent is extended or adjusted under 35 U.S.C. 154(b) by 345 days.

(21) Appl. No.: 17/613,428

(22) PCT Filed: May 15, 2020

(86) PCT No.: PCT/KR2020/006428

§ 371 (c)(1),
(2) Date: Nov. 22, 2021

(87) PCT Pub. No.: WO2020/235879

PCT Pub. Date: Nov. 26, 2020

(65) Prior Publication Data

US 2022/0316759 A1 Oct. 6, 2022

(30) Foreign Application Priority Data

May 21, 2019 (KR) ..... 10-2019-0059663

(51) Int. Cl.
*F24H 9/00* (2022.01)
*F24H 1/28* (2022.01)
(Continued)

(52) U.S. Cl.
CPC ..... *F24H 9/0031* (2013.01); *F24H 1/285* (2013.01); *F28F 1/06* (2013.01); *F28F 13/08* (2013.01)

(58) Field of Classification Search
CPC ..... F28F 1/06; F28F 1/426; F24H 9/0031
See application file for complete search history.

(56) References Cited

U.S. PATENT DOCUMENTS 1,991,788 A * 2/1935 Cartter ..... F24H 1/205 126/91 A
2,197,243 A * 4/1940 Moran ..... G01N 25/145 165/177

(Continued)

FOREIGN PATENT DOCUMENTS

CN 106482564 A * 3/2017
DE 10 2014 213 491 A1 1/2016

(Continued)

OTHER PUBLICATIONS

International Search Report issued in PCT/KR2020/006428; mailed Aug. 7, 2020.

(Continued)

*Primary Examiner* — Jorge A Pereiro
*Assistant Examiner* — Michael James Giordano
(74) *Attorney, Agent, or Firm* — Studebaker Brackett PLLC

(57) ABSTRACT

The present disclosure relates to a wavy smoke tube structure of a boiler, which improves heat exchange efficiency of a smoke tube. The wavy smoke tube structure includes: a main body formed in a columnar shape and having a space therein; a plurality of first concave portions concavely formed along a first side portion in a longitudinal direction of the main body; a plurality of second concave portions concavely formed along a second side portion in the longitudinal direction of the main body opposite to the first side portion and each positioned between a pair of the first concave portions to face them; and a plurality of blocking grooves formed in a pair of sidewall portions provided between the first side portion and the second side portion.

5 Claims, 7 Drawing Sheets

(51) Int. Cl.
*F28F 1/06* (2006.01)
*F28F 13/08* (2006.01)

(56) References Cited

U.S. PATENT DOCUMENTS

| | | | | |
|---|---|---|---|---|
| 2005/0230094 | A1* | 10/2005 | Komatsubara | F28F 13/12 165/177 |
| 2007/0034170 | A1* | 2/2007 | Lannes | F28F 1/08 122/18.3 |
| 2008/0029243 | A1 | 2/2008 | O'Donnell et al. | |
| 2016/0245598 | A1* | 8/2016 | Bosscher | F28F 1/025 |

FOREIGN PATENT DOCUMENTS

| | | | | |
|---|---|---|---|---|
| KR | 10-2000-0018125 | A | | 4/2000 |
| KR | 20000018125 | A | * | 4/2000 |
| KR | 10-2013-0085089 | A | | 7/2013 |
| KR | 20130085089 | A | * | 7/2013 |
| KR | 10-2016-0081914 | A | | 7/2016 |

OTHER PUBLICATIONS

Written Opinion of the International Searching Authority issued in PCT/KR2020/006428; mailed Aug. 7, 2020.

* cited by examiner

-- Prior Art--

-- Prior Art--

-- Prior Art--

-- Prior Art--

-- Prior Art--

WAVY SMOKE TUBE STRUCTURE OF BOILER

CROSS-REFERENCE TO RELATED APPLICATIONS

This application is the U.S. National Stage of International Application No. PCT/KR2020/006428 filed May 15, 2020, which claims benefit of priority to Korean Patent Application No. 10-2019-0059663 filed May 21, 2019, the entire content of which is incorporated herein by reference.

BACKGROUND OF THE DISCLOSURE

Field of the Disclosure

The present disclosure relates to a wavy smoke tube structure of a boiler, and more particularly, to a wavy smoke tube structure of a boiler to improve heat exchange efficiency of the smoke tube.

Related Art

In general, a gas boiler uses a gas as fuel and water as a heating medium for heating, and in the case of a hot water and heating boiler, it is a combustor that circulates heating water inside the boiler through a three-way valve and heats feed water in a form of indirect heat exchange to make hot water available. The gas boiler is installed in various buildings such as a house, an office, a factory and the like, and is configured to supply hot water or heating water. The gas boiler may be classified into a general boiler and a condensing boiler depending on whether condensate is generated, and classified into an instantaneous type boiler and a hot water storage type boiler depending on a hot water supply method. Referring to a basic structure of such a gas boiler, a combustion device and a heat exchanger are provided inside a housing. In the combustion device, a flame by fuel, i.e., gas, is combusted in a form of a free flame having an appropriate length. Then, the combustion gas from the combustion device is discharged through a smoke tube after exchanging heat with a heating medium in the heat exchanger.

FIG. 1 is a diagram illustrating a conventional boiler. Referring to FIG. 1, a conventional boiler 10 includes a heat exchanger 14 having a plurality of smoke tubes 15 inside a main body 12, and a burner unit 16 for ejecting flames to the smoke tubes 15 of the heat exchanger 14, an air intake unit for supplying air to the burner unit 16, and an exhaust unit 19 for discharging combustion gas generated from the burner unit 16 to the outside. When the direct water is supplied into the main body 12 from the outside, the direct water comes into contact with the plurality of smoke tubes 15 provided inside the case and performs heat-exchange to be hot water, and the hot water thus formed is supplied to a hot water pipe (not shown) through a circulation pump (not shown) and the like.

FIG. 2 is a perspective view illustrating a smoke tube applied to the conventional boiler, and FIG. 3 is a side view illustrating the smoke tube applied to the conventional boiler.

FIGS. 1 to 3, the conventional smoke tube 15 is formed in a long smoke tube shape, and a plurality of first concave portions 15*a* are formed along one longitudinal side thereof, and a plurality of second concave portions 15*b* are formed along the other longitudinal side thereof. Further, the first concave portion 15*a* and the second concave portion 15*b* are configured to repeat in a zigzag shape, so that the second concave portion 15*b* is positioned between the pair of first concave portions 15*a* facing each other.

FIG. 4 is a perspective view illustrating a flow analysis of fluid over time in the smoke tube applied to the conventional boiler, and FIG. 5 is a side view illustrating a flow analysis of fluid over time in the smoke tube applied to the conventional boiler.

Referring to FIGS. 1 to 5, the second concave portion 15*b* is provided between the pair of first concave portions 15*a*, and conversely, the first concave portion 15*a* is provided between the pair of second concave portions 15*b*, so that an inner diameter of the smoke tube 15 in which the centers of the first and second concave portions 15*a* and 15*b* are located is reduced and an inner diameter of the tube 15 in which the ends of the first and second concave portions 15*a* and 15*b* are positioned is also reduced. As such, when the inner diameter of the smoke tube 15 is reduced, the flame moving along the smoke tube 15 is slowly moved along the inside of the smoke tube 15 which has become smaller, so that the heat of the flame is efficiently transferred to the smoke tube 15.

Meanwhile, the flow rate of the fluid inserted into the smoke tube 15 increases as it passes through a narrow passage, and decreases as it passes through a wide passage, according to Bernoulli's principle. Accordingly, it can be seen that the flow rate becomes relatively slow in both end portions of the pair of first concave portions 15*a* and both end portions of the pair of second concave portions 15*b*, and the flow rate becomes relatively fast in the central portions of the first concave portion 15*a* and the second concave portion 15*b*. This means that the inner diameter of the smoke tube 15 adjacent to both ends of the first and second concave portions 15*a* and 15*b* becomes relatively large, and the inner diameter of the smoke tube 15 adjacent to the centers of the first and second concave portions 15*a* and 15*b* becomes relatively small.

Accordingly, if the inner diameter of the smoke tube 15 adjacent to both ends of the pair of first and second concave portions 15*a* and 15*b* is also reduced, the flame moving along the smoke tube 15 can stay longer, but since the structure has not been developed yet, improvement of the heat exchange efficiency of the smoke tube 15 is at a standstill.

SUMMARY

The present disclosure provides a wavy smoke tube structure of a boiler to improve heat exchange efficiency of the smoke tube.

In an aspect, the present disclosure provides a wavy smoke tube structure of a boiler, including: a main body formed in a columnar shape and having a space therein; a plurality of first concave portions concavely formed along a first side portion in a longitudinal direction of the main body; a plurality of second concave portions concavely formed along a second side portion in the longitudinal direction of the main body opposite to the first side portion and each positioned between a pair of the first concave portions to face them; and a plurality of blocking grooves formed in a pair of sidewall portions provided between the first side portion and the second side portion.

Further, the sidewall portions may include a first sidewall portion provided on one longitudinal side between the first side portion and the second side portion, and a second sidewall portion provided on the other longitudinal side between the first side portion and the second side portion, a center of each of the second concave portions may be positioned between opposite ends of the plurality of first concave portions to face them, and the plurality of the blocking grooves may be formed along the longitudinal direction of the first sidewall portion and the second sidewall portion, and are concavely formed between the opposite ends of the plurality of first concave portions and the center of each of the second concave portions.

In addition, each of the blocking grooves may be concavely formed in a hemispherical shape.

Furthermore, the wavy smoke tube structure may further include a concave end portion formed concavely at one end of a pair of sidewall portions.

Further, a diameter between the pair of sidewall portions becomes smaller by the concave end portion as it goes toward ends of the sidewall portions.

According to the present disclosure, since the blocking grooves are formed in the sidewall portions of the main body, the flame moving along the smoke tube stays longer around the blocking groove, which results in more efficient transfer of the heat of the flame to the smoke tube. In addition, the flame moving along the smoke tube stays longer around the concave end portion, which results in more efficient transfer of the heat of the flame to the smoke tube.

DESCRIPTION OF REFERENCE NUMERALS

| | |
|---|---|
| 100: smoke tube | 110: main body |
| 111: first side portion | 112: second side portion |
| 113: first sidewall portion | 114: second sidewall portion |
| 120: first concave portion | 122: second concave portion |
| 130: blocking groove | 140: concave end portion |

DESCRIPTION OF EXEMPLARY EMBODIMENTS

Hereinafter, a wavy smoke tube structure of a boiler according to one embodiment of the present disclosure will be described in more detail with reference to the accompanying drawings.

Figure 1:
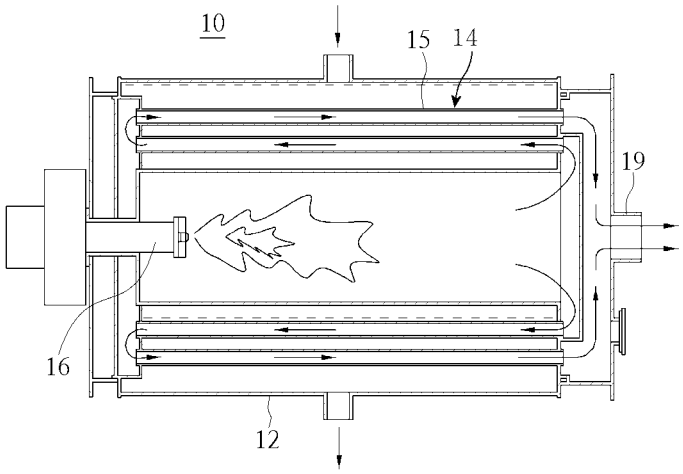
FIG. 1 is a diagram illustrating a conventional boiler.
Figure 2:
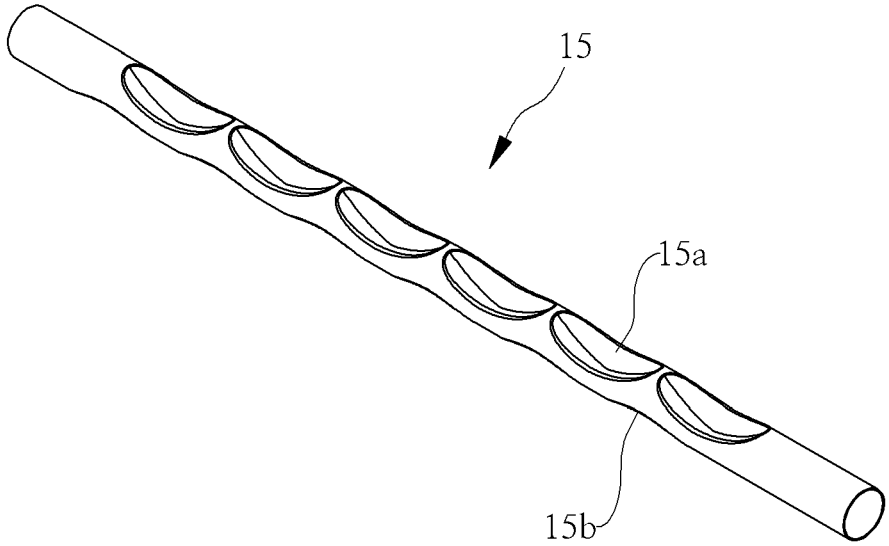
FIG. 2 is a perspective view illustrating a smoke tube applied to the conventional boiler.
Figure 3:
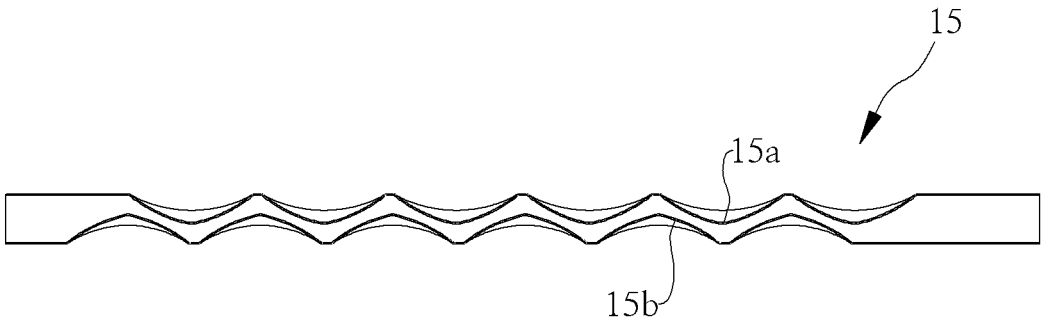
FIG. 3 is a side view illustrating the smoke tube applied to the conventional boiler.
Figure 4:
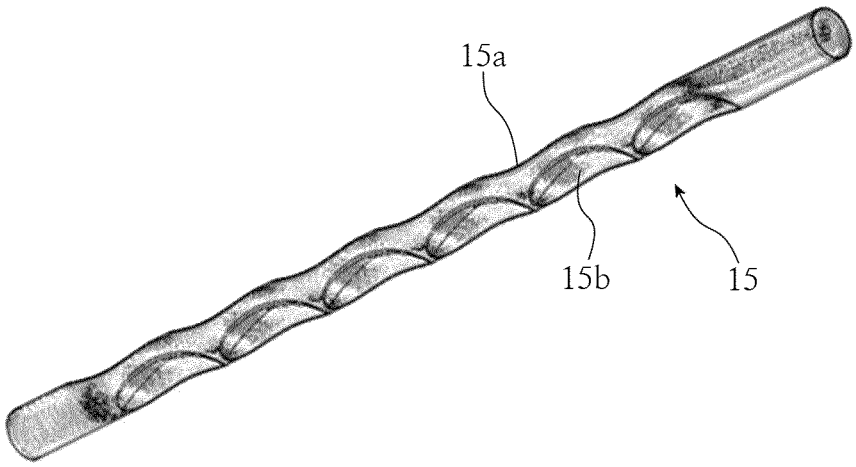
FIG. 4 is a perspective view illustrating a flow analysis of fluid over time in the smoke tube applied to the conventional boiler.
Figure 5:
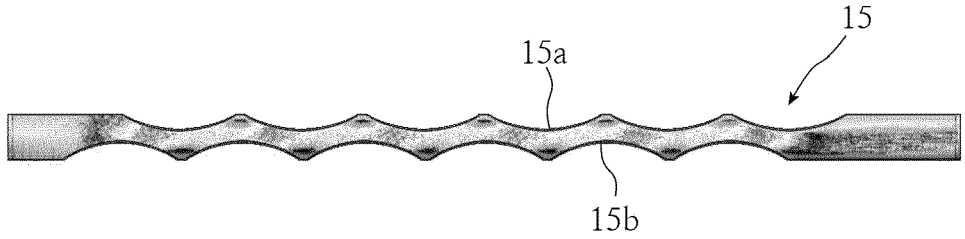
FIG. 5 is a side view illustrating a flow analysis of fluid over time in the smoke tube applied to the conventional boiler.
Figure 6:
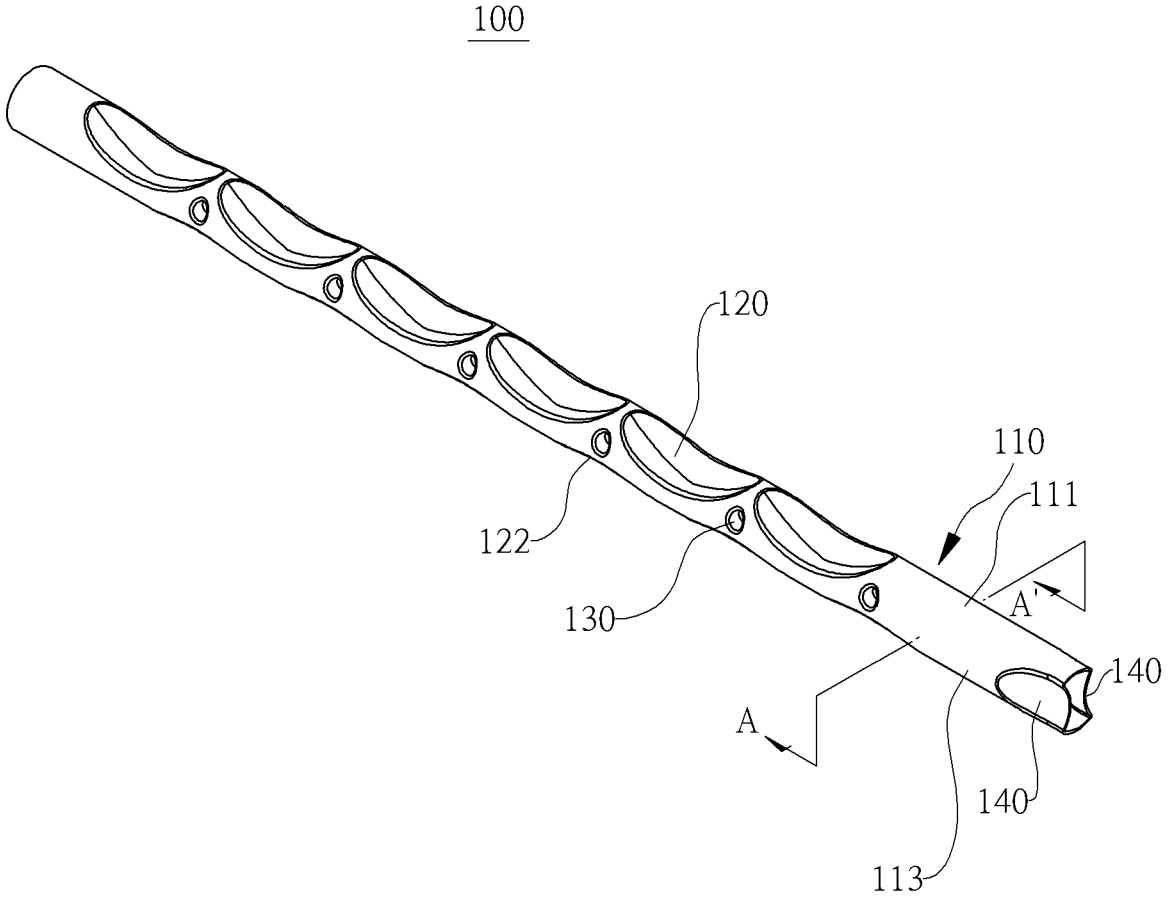
FIG. 6 is a perspective view schematically illustrating a wavy smoke tube structure of a boiler according to one embodiment of the present disclosure.
Figure 7:
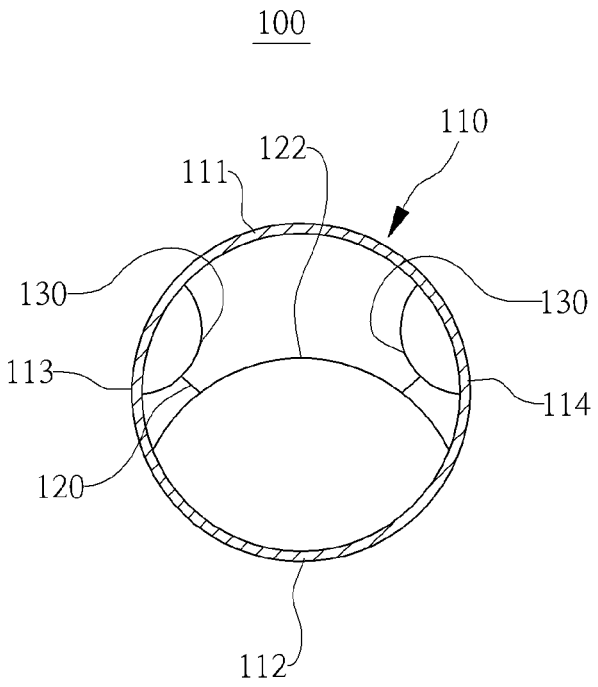
FIG. 7 is a cross-sectional view taken along line A-A' of FIG. 6.

FIG. 6 is a perspective view schematically illustrating a wavy smoke tube structure of a boiler according to one embodiment of the present disclosure, and FIG. 7 is a cross-sectional view taken along line A-A' of FIG. 6.

Referring to FIGS. 6 and 7, the wavy smoke tube of the boiler according to the embodiment of the present disclosure includes a smoke tube 100, and the smoke tube 100 includes a main body 110, first and second concave portions 120, 122, a blocking groove 130 and a concave end portion 140.

The smoke tube 100 is configured as a passage through which combustion gas generated from a burner of the boiler moves, and external direct water supplied to the boiler is heat-exchanged to be hot water while coming into contact with the smoke tube 100. As the combustion gas moves slowly, more heat of the combustion gas is transferred to the smoke tube 100, so that the heat exchange efficiency of the smoke tube 100 is improved.

The main body 110 is to form an appearance of the smoke tube 100, is formed in a long column shape and includes an empty space therein. The combustion gas of the burner is moved from one end in the longitudinal direction of the main body 110 to the other end through the empty space inside the main body 110. The main body 110 is provided with a first side portion 111 on one longitudinal side, and a second side portion 112 is provided on the other longitudinal side of the main body 110 which is opposite to the first side portion 111, a first sidewall portion 113 is provided on one longitudinal side between the first side portion 111 and the second side portion 112, and a second sidewall portion 114 is provided on the other longitudinal side between the first side portion 111 and the second side portion 112.

Figure 8:
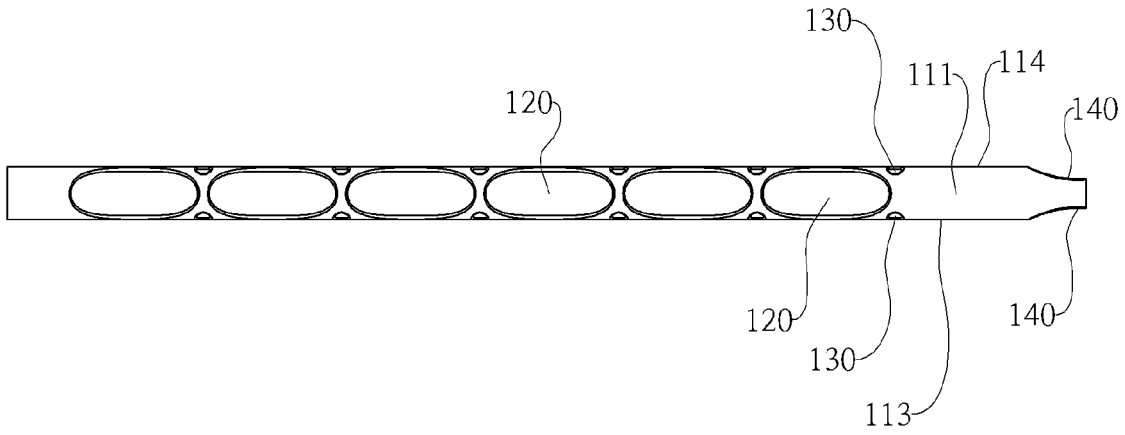
FIG. 8 is a plan view schematically illustrating the wavy smoke tube structure of the boiler according to one embodiment of the present disclosure.
Figure 9:
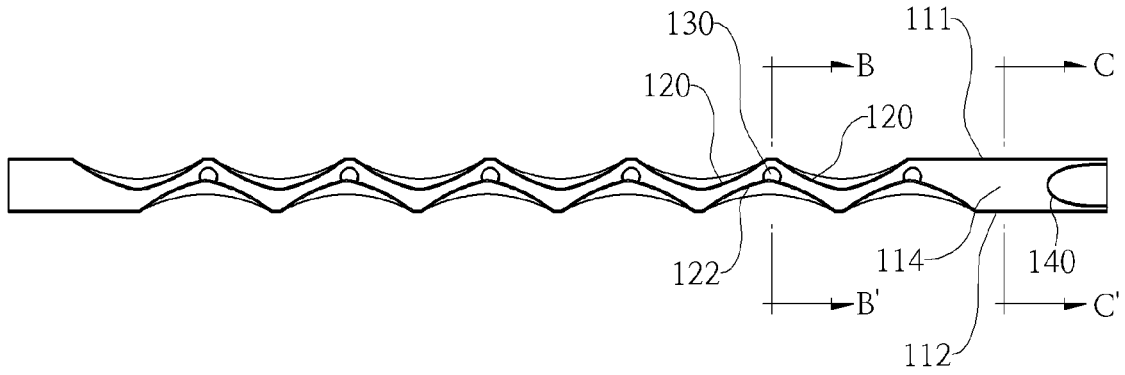
FIG. 9 is a side view schematically illustrating the wavy smoke tube structure of the boiler according to one embodiment of the present disclosure.

FIG. 8 is a plan view schematically illustrating the wavy smoke tube structure of the boiler according to one embodiment of the present disclosure, and FIG. 9 is a side view schematically illustrating the wavy smoke tube structure of the boiler according to one embodiment of the present disclosure.

Referring to FIGS. 6 to 9, a plurality of first concave portions 120 are formed in a wavy shape along the longitudinal direction of the first side portion 111. The first concave portions 120 are arranged in series with each other, and a pair of first concave portions 120 facing each other is spaced apart from each other. A plurality of second concave portions 122 are formed in a wavy shape along the longitudinal direction of the second side portion 112. The second concave portions 122 are arranged in series with each other, and a pair of second concave portions 122 facing each other is spaced apart from each other. In this case, the second concave portion 122 is positioned between the pair of first concave portions 120 to face them, and the center of the second concave portion 122 is positioned between the opposite ends of the plurality of first concave portions 120 to face them.

A plurality of blocking grooves 130 are formed along the longitudinal direction of the first sidewall portion 113 and the second sidewall portion 114, and the blocking grooves 130 are concavely formed between the opposite ends of the plurality of first concave portions 120 and the center of the second concave portions 122. The blocking groove 130 is concavely formed in a hemispherical shape. In addition, a diameter between the opposite ends of the pair of first concave portions 120 and the center of the second concave portion 122 becomes smaller by the blocking groove 130.

The concave end portion 140 is concavely formed at one end of the pair of sidewall portions. A diameter between the first and second sidewall portions 113 and 114 becomes smaller by the concave end portion 140 as it goes toward the ends of the first and second sidewall portions 113 and 114.

Figure 10:
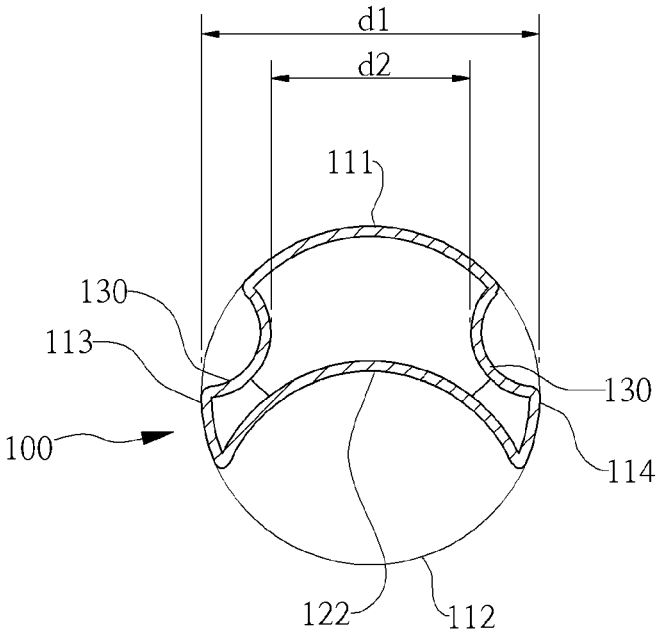
FIG. 10 is a cross-sectional view taken along line B-B' of FIG. 9.
Figure 11:
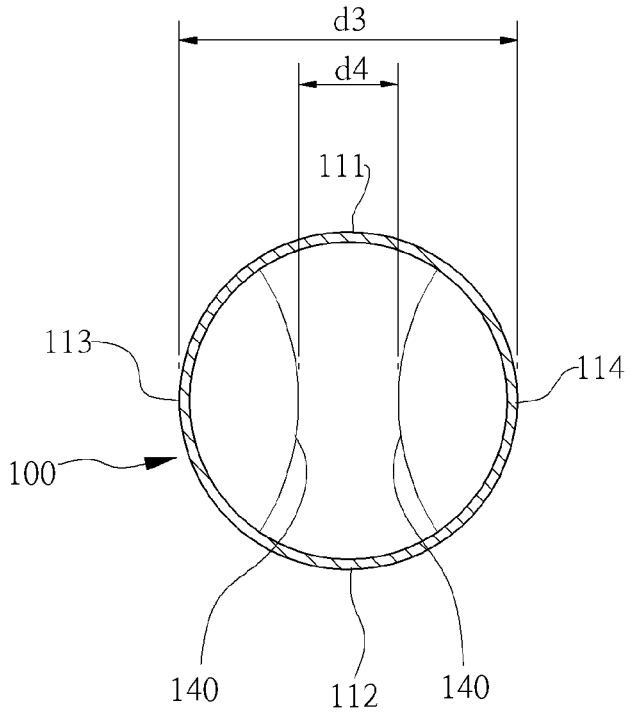
FIG. 11 is a cross-sectional view taken along line C-C' of FIG. 9.

FIG. 10 is a cross-sectional view taken along line B-B' of FIG. 9, and FIG. 11 is a cross-sectional view taken along line C-C' of FIG. 9.

Referring to FIGS. 6 to 11, a diameter d2 between the pair of blocking grooves 130 provided in the first and second sidewall portions 113 and 114 is configured to be smaller than a diameter d1 between the first and second sidewall portions 113 and 114 without the pair of blocking grooves 130. Accordingly, the flame moving along the smoke tube 100 moves more slowly while being blocked by the blocking grooves 130.

In addition, a diameter d4 between the pair of concave end portions 140 provided in the first and second sidewall portions 113 and 114 is configured to be smaller than a diameter d3 between the first and second sidewall portions 113 without the pair of concave end portions 140. Accordingly, the flame moving along the smoke tube 100 moves more slowly while being blocked by the concave end portions 140.

Figure 12:
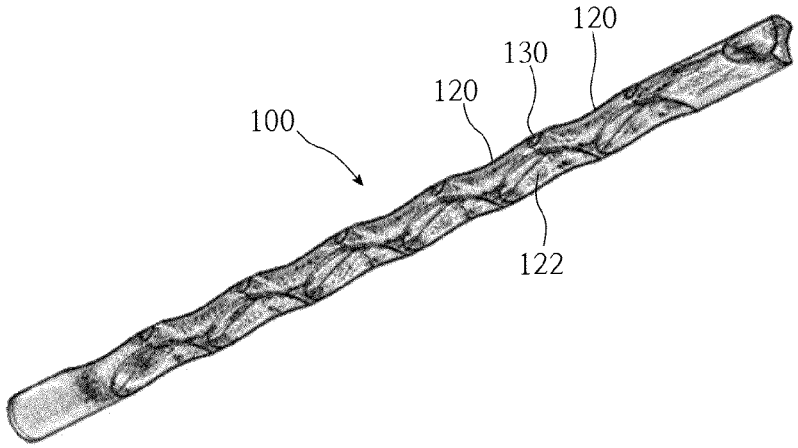
FIG. 12 is a perspective view illustrating a flow analysis of a fluid over time of the wavy smoke tube structure of the boiler according to one embodiment of the present disclosure.
Figure 13:
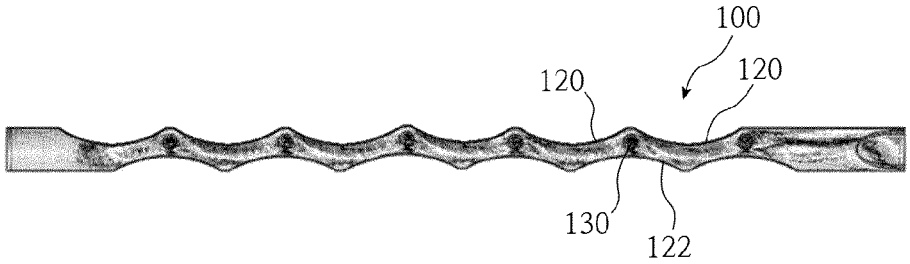
FIG. 13 is a side view illustrating a flow analysis of a fluid over time of the wavy smoke tube structure of the boiler according to one embodiment of the present disclosure.

FIG. 12 is a perspective view illustrating a flow analysis of a fluid over time of the wavy smoke tube structure of the boiler according to one embodiment of the present disclosure, and FIG. 13 is a side view illustrating a flow analysis of a fluid over time of the wavy smoke tube structure of the boiler according to one embodiment of the present disclosure.

Referring to FIGS. 4 to 13, the flow rate of the fluid inserted into the smoke tube 100 increases as it passes through a narrow passage, and decreases as it passes through a wide passage, according to Bernoulli's principle. Based on this rule, first, referring to FIGS. 4 and 5, it can be seen that the flow rate of the fluid relatively increases in the central portion of the first and second concave portions 15*a* and 15*b*.

Then, referring to FIGS. 12 and 13, it can be seen that the flow rate of the fluid in the central portion of the first and second concave portions 120 and 122 relatively increases, and the flow rate of the fluid around both ends of the pair of first concave portions 120 also relatively increases. This means that, due to the blocking groove 130 formed between both ends of the pair of first concave portions 120 and the center of the second concave portion 122, a diameter around the blocking groove 130 becomes relatively small. Accordingly, the flame moving along the smoke tube 100 stays longer around the blocking groove 130, which results in more efficient transfer of the heat of the flame to the smoke tube 100.

In addition, it can be seen that the flow rate of the fluid relatively increases even around the concave end portion 140. This means that, due to the pair of concave end portions 140, a diameter of the smoke tube 100 around the concave end portion 140 becomes relatively small, and accordingly, the flame moving along the smoke tube 100 stays longer around the concave end portion 140, which results in more efficient transfer of the heat of the flame to the smoke tube 100.

Although the present disclosure has been described in detail in the above embodiments, it goes without saying that the present disclosure is not limited thereto, and it is apparent to those skilled in the art that various changes and modifications may be made within the scope of the technical spirit of the present disclosure, and these variations and modifications fall within the scope of the appended claims, the technical idea should also be regarded as belonging to the present disclosure.

What is claimed is:

1. A wavy smoke tube structure of a boiler, comprising:

a main body formed in a columnar shape and having a space therein;

a plurality of first concave portions concavely formed along a first side portion in a longitudinal direction of the main body;

a plurality of second concave portions concavely formed along a second side portion in the longitudinal direction of the main body opposite to the first side portion and each positioned between a pair of the first concave portions to face them; and a plurality of blocking grooves formed in a pair of sidewall portions provided between the first side portion and the second side portion, wherein each first concave portion of the plurality of first concave portions has a portion overlapping with a portion of a second concave portion of the plurality of second concave portions in a transverse direction of the main body, wherein in a cross-sectional view of the wavy smoke tube structure, each blocking groove of the plurality of blocking grooves is separated from the plurality of first concave portions and the plurality of second concave portions, wherein in a plan view of the wavy smoke tube structure, a respective pair of two blocking groove of the plurality of blocking grooves is separated from any first concave portion of the plurality of first concave portions and is overlapped with a middle portion in a longitudinal direction of one second concave portion of the plurality of second concave portions, wherein the plurality of the blocking grooves are positioned only in particular portions, which are adjacent to the center of each of the second concave portions and between the opposite ends of the plurality of first concave portions, and wherein a flame moving along the main body moves slowly while being blocked by the blocking grooves.

2. The wavy smoke tube structure of claim 1, wherein the sidewall portions include a first sidewall portion provided on one longitudinal side between the first side portion and the second side portion, and a second sidewall portion provided on the other longitudinal side between the first side portion and the second side portion, a center of each of the second concave portions is positioned between opposite ends of the plurality of first concave portions to face them, and the plurality of the blocking grooves are concavely formed along the longitudinal direction of the first sidewall portion and the second sidewall portion.

3. The wavy smoke tube structure of claim 2, wherein each of the blocking grooves is concavely formed in a hemispherical shape.

4. The wavy smoke tube structure of claim 1, further comprising:

a concave end portion formed concavely at one end of a pair of sidewall portions.

5. The wavy smoke tube structure of claim 4, wherein a diameter between the pair of sidewall portions becomes smaller by the concave end portion as it goes toward ends of the sidewall portions.

* * * * *